US010392865B2

(12) United States Patent
Lindblom et al.

(10) Patent No.: US 10,392,865 B2
(45) Date of Patent: Aug. 27, 2019

(54) CUTTER FOR BORING HEAD

(71) Applicant: SANDVIK INTELLECTUAL PROPERTY AB, Sandviken (SE)

(72) Inventors: Anders Lindblom, Sandviken (SE); Joona Loikkanen, Sandviken (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 162 days.

(21) Appl. No.: 15/561,015

(22) PCT Filed: Feb. 25, 2016

(86) PCT No.: PCT/EP2016/053961

§ 371 (c)(1),
(2) Date: Sep. 22, 2017

(87) PCT Pub. No.: WO2016/150643

PCT Pub. Date: Sep. 29, 2016

(65) Prior Publication Data

US 2018/0051519 A1 Feb. 22, 2018

(30) Foreign Application Priority Data

Mar. 25, 2015 (EP) ..... 15160819

(51) Int. Cl.

| | |
|---|---|
| ***E21B 10/24*** | (2006.01) |
| *E21B 10/22* | (2006.01) |
| *E21B 7/28* | (2006.01) |
| *E21B 10/25* | (2006.01) |

(52) U.S. Cl.

CPC ..... *E21B 10/24* (2013.01); *E21B 7/28* (2013.01); *E21B 10/22* (2013.01); *E21B 10/246* (2013.01); *E21B 10/25* (2013.01)

(58) Field of Classification Search

CPC ..... E21B 10/24; E21B 10/25; E21B 10/22; E21B 10/246; E21B 7/28

See application file for complete search history.

(56) References Cited

U.S. PATENT DOCUMENTS

| | | | | |
|---|---|---|---|---|
| 3,244,459 | A * | 4/1966 | Ortloff | E21B 10/246 175/229 |
| 4,335,791 | A | 6/1982 | Evans | |
| 4,509,607 | A | 4/1985 | Saxman et al. | |
| 5,363,930 | A | 11/1994 | Hern | |
| 6,203,110 | B1 | 3/2001 | Slaughter et al. | |
| 6,206,110 | B1 * | 3/2001 | Slaughter, Jr. | E21B 10/003 175/227 |
| 2006/0249311 | A1 | 11/2006 | Thuresson et al. | |

FOREIGN PATENT DOCUMENTS

| | | |
|---|---|---|
| WO | 95/08692 A1 | 3/1995 |
| WO | 96/25581 A1 | 8/1996 |

* cited by examiner

*Primary Examiner* — George S Gray
(74) *Attorney, Agent, or Firm* — Corinne R. Gorski

(57) ABSTRACT

A cutter for a boring head having a shaft is mountable at a saddle. A roller body is rotatably mounted about the shaft via bearings housed at a cavity located radially between the shaft and the roller body. A lubrication fluid is configured to flow internally within the shaft via a first and second passageway. An elongate overflow chamber is provided in fluid communication with the passageways to receive thermally expanded lubrication fluid from the cavity.

15 Claims, 5 Drawing Sheets

CUTTER FOR BORING HEAD

RELATED APPLICATION DATA

This application is a § 371 National Stage Application of PCT International Application No. PCT/EP2016/053961 filed Feb. 25, 2016 claiming priority to EP 15160819.7 filed Mar. 25, 2015.

FIELD OF INVENTION

The present invention relates to a cutter for a boring head and in particular, although not exclusively, to a cutter having a lubricant overflow chamber positioned within a shaft of the cutter to receive thermally expanded lubrication fluid.

BACKGROUND ART

Rotatable earth boring apparatus typically comprises an array of cutters (or reaming heads) mounted at a boring head. Depending upon the number, size and configuration of the cutters at the head, the apparatus may be configured for pilot drilling, raise, blind, horizontal or down boring applications.

Conventionally, an outer cutting roller body is rotatably mounted on a shaft (or journal) that is in turn removably mounted at a saddle secured to the boring head. An annular cavity is defined between the shaft and the roller body in which is mounted bearings to allow the roller body to rotate relative to the shaft and to cut the rock via cutting elements distributed over the external facing surface of the body. Seals are provided at the cavity to retain a lubrication fluid (typically grease) within the cavity and in contact with the bearings. Example boring head mounted cutters are described in U.S. Pat. No. 4,509,607; US 2006/0249311; U.S. Pat. No. 5,363,930 and WO 95/08692.

To avoid premature component wear and to optimise cutting, it is important that the bearings are lubricated continuously during use. This is because the cutter is subjected to heavy loading forces and high temperatures generated by rotation of the roller body relative to the shaft and the frictional contact as the cutter bores into the rock. Due to the heat generation, the lubrication fluid expands and the internal pressure within the bearing cavity rises which in turn significantly increases the cutter internal pressure. It is therefore not uncommon for the cavity seals to fail resulting in loss of grease from the bearings and a correspondent reduction in the service lifetime of the cutter.

U.S. Pat. Nos. 5,636,930 and 4,509,607 disclose elastomeric pressure compensators mounted internally within the shaft or at the region of the bearing cavity to act as lubricant reservoirs to receive thermally expanded lubricant and to relieve the pressure on the bearing seals in an attempt to avoid seal failure. However, the use of elastomeric fluid reservoirs is disadvantageous for a number of reasons. Firstly, the elastomers must be inserted to their internal mounting position within the cutter which introduces additional assembly steps and increases the cutter component complexity. After the cutter has cooled following use, the elastomers retain a certain volume of the lubricant such that a depleted volume is returned to the bearings. As more lubricant is introduced to compensate for this retention, eventually the elastomers become saturated and their capacity to receive expanded lubricant is reduced. Additionally, the specific positioning of the elastomers within the cutter is not optimised to facilitate firstly introduction of the lubricant and secondly the ease with which the lubricant is capable of flowing between the bearing cavity and the thermal expansion reservoir as the cutter temperature rises and falls. Accordingly, what is required is a cutter that addresses the above problems.

SUMMARY OF THE INVENTION

It is an objective for the present invention to provide a cutter for a boring head having a bearing lubricant overflow chamber that facilitates both the introduction of the lubricant into the cutter and the unrestricted flow of lubricant between the bearing cavity and the overflow chamber. It is a further specific objective to provide an overflow chamber for the bearing lubricant that is effective to protect the bearing seals by receiving thermally expanded lubricant whilst ensuring the entire volume of the expanded lubricant is returned to the bearing cavity once the cutter (and the lubrication fluid) cools.

It is a further specific objective to provide a cutter having a lubricant overflow chamber that is convenient to manufacture and does not compromise the strength of the cutter to withstand the significant loading forces encountered during use. It is a yet further objective to provide a cutter compatible for use with a variety of different types and grade of lubricant whilst also being compatible for use with different configurations of roller bodies and cutting inserts so as to provide a cutter suitable for pilot drilling, raise, blind, horizontal or down boring.

The objectives are achieved by providing a cutter having a roller body (mounting a plurality of cutting inserts) that is rotatably mounted upon a shaft (or journal) that comprises an internal lubrication fluid overflow chamber to receive thermally expanded lubricant as the cutter and the lubricant are heated during use.

According to a first aspect of the present invention there is provided a cutter for a boring head, the cutter comprising; a shaft having a longitudinal axis mountable at a saddle of a boring head; a roller body rotatably mounted about the shaft and having cutting elements provided at an external face; bearings mounted within an annular cavity located radially between the shaft and the roller body; a first passageway centred on the axis of the shaft and extending axially through the shaft from a first end; and a second passageway extending transverse or perpendicular to the first passageway to provide a fluid link between the first passageway and the cavity; characterised by: an elongate overflow chamber centred on the axis of the shaft and formed as an elongate axial extension of the first passageway to extend axially through the shaft beyond the second passageway as a blind bore, the chamber having an unoccupied internal volume along the axial length configured to receive a lubrication fluid from the annular cavity.

The overflow chamber being formed as an elongate axial extension of the first passageway is advantageous for convenient manufacture via, for example, a two stage pilot boring process. Axially aligning the first passageway and the elongate overflow chamber to be centred on the longitudinal axis of the shaft is beneficial to maximise the strength of the shaft and not to compromise the structural integrity of the cutter mounted at the saddle. The relative positioning of the present overflow chamber being radially remote from the bearing cavity region is advantageous so as to not 'interfere' with the design and function of the bearings and the bearing cavity so that this region may be optimised to frictionally support the rotational mounting of the roller body at the shaft.

Advantageously, the internal volume of the overflow chamber is unoccupied or 'free' with regard to internally mounted components such as elastomers or other porous or absorbent structures that would otherwise hinder the free flow of lubricant between the chamber and the region of the bearing cavity. The empty overflow chamber accordingly allows the unrestricted return flow of lubricant to the bearing cavity as the lubricant cools.

The coaxial alignment of the first passageway and the elongate overflow chamber is further advantageous to greatly facilitate the introduction of lubricant into the bearing region. For example, an elongate rod like tool may be inserted axially into the first passageway and the overflow chamber such that an end region of the rod is configured for insertion into the chamber to block or seal it and prevent the lubricant flowing into the chamber and to direct it into the region of the bearing cavity. This ensure the entire volume of the fluid is introduced into the bearing cavity. The configuration of the present overflow chamber being an elongate axial extension of the first passageway therefore ensures the chamber receives lubricant only as the lubricant is heated.

Advantageously, the elongate axial length of the chamber terminates within the shaft such that the chamber does not extend to a second end of the shaft. Such an arrangement is beneficial to maximise the radial thickness and hence maintain the structural strength of the shaft at the end region that is mated with the saddle so as to withstand the loading forces during use and reduce the risk of shaft failure.

Preferably, the free volume of the chamber is sufficient to receive a desired volume the expanded lubricant so as to protect the seals. For example, the seals may typically be configured to withstand a pressure of around 0.3 to 0.4 MPa. The desired chamber volume is achieved by forming the chamber with a suitable elongation. That is, the chamber comprises an axial length being greater than its diameter. Optionally the axial length of the chamber is in the range 1.5 to 5.0, 2.0 to 4.0 or more preferably 2.5 to 3.5 times the diameter or width of chamber in a radial direction perpendicular to the axial length. Such a configuration is advantageous as it does not appreciably weaken the strength of the shaft to withstand the loading forces.

Preferably, the first passageway and the chamber are substantially cylindrical. More preferably, a diameter of the first passageway is greater than a diameter of the chamber. Such a configuration is advantageous for manufacture of the cutter to enable a convenient two stage pilot boring operation in which the first passageway may be formed by a first drilling operation and then the overflow chamber formed by a second stage drilling operation as an axial extension of the first passageway. Optionally, an axial length of the first passageway is greater than the axial length of the chamber. Optionally, an axial length of the chamber is greater than a length of the second passageway between the cavity and the first passageway. The length of the first passageway is defined between the first end of the shaft and the axially innermost part of the passageway that interfaces with the second passageway. Preferably, the first passageway innermost end is defined by a step that projects radially inward towards the axis. Additionally, an axial length of the second passageway may be defined as the radial distance between the internal facing wall that defines the first passageway and the external surface of the shaft that mounts the bearings. A corresponding axial length of the overflow chamber may be defined as the length between the axially innermost blind end of the chamber positioned closest to the second end of the shaft and the region of the radially inward step provided at the end of the first passageway.

Optionally, a volume of the first passageway is greater than a volume of the chamber. The volume of the overflow chamber is sufficient to receive the desired volume of thermally expanded lubricant. Such a configuration is advantageous to maintain the strength of the shaft and not to compromise the shaft integrity to withstand the significant loading forces during use of the order of 20 to 25 metric tonnes.

Preferably, an axial junction of the first passageway and the chamber comprises an abutment or a step that projects radially inward towards the axis. This step or abutment is beneficial to provide an end-stop for a plug removably mounted within the first passageway and to facilitate loading and removal of ball bearings into the bearing cavity during assembly or servicing of the cutter.

Preferably, the cutter further comprises a first plug removably mounted in the first passageway to close an open end of the first passageway and a second plug removably mounted in the second passageway. The first plug is configured to facilitate loading of bearings into the bearing cavity and to seal the bearing cavity and internal passageways within the shaft. The second plug is similarly configured to maintain the bearings in position underneath the roller body and to control the free flow of lubricant from the bearing cavity. Preferably, the first and second plugs each comprise at least one communication bore to provide a fluid flow path between the cavity and the respective first and second passageways. The communication bores are advantageous to allow fluid communication between the bearing cavity and the first passageway, the second passageway and the overflow chamber. The diameter of the communication bores may be selected to control the flow of the lubricant with respect to the temperature and accordingly the viscosity of the lubricant as it thermally expands during operation of the cutter. Advantageously, a diameter and volume of the overflow chamber is greater than a corresponding diameter or volume of each of the communication bores to allow the thermally expanded fluid to collect in the overflow chamber when heated.

Preferably, the cutter further comprises at least one communication bore extending through the shaft directly between the chamber and the bearing cavity to allow the transfer of the lubrication fluid between the chamber and the cavity. Preferably, the cutter comprises a plurality of communication bores extending transverse or perpendicular to the chamber from one end of the chamber axially furthest from the second passageway. Optionally, two communication bores extend perpendicular and radially outward from the innermost end of the cylindrical overflow chamber. Accordingly, the communication bores extending from the chamber are axially spaced from the second passageway so as to define a fluid flow circuit between the axially centred first passageway and overflow chamber and the surrounding annular bearing cavity. The communication bores are advantageous to facilitate the fluid transfer between the bearing cavity and the overflow chamber. Axial separation of the second passageway and the communication bores at the axial end of the chamber is advantageous to provide lubricant pathways directed radially inward from the bearing cavity at different axial positions along the length of the shaft. Optionally, one or a plurality of communication bores may extend radially between the bearing cavity and the first passageway being positioned axially closer to the first end of the shaft relative to the axial positioning of the second passageway.

Preferably, a volume of the chamber is less than an unoccupied free volume of the cavity. Such a configuration is advantageous such that the majority of the lubricant is retained in the bearing cavity whilst providing a sufficient volume for thermally expanded lubricant to flow to avoid failure of the bearing seals. This ensures the bearings are continually lubricated when operating at high temperatures to avoid premature wear of the cutter. Optionally, the volume of the chamber is in the range 5 to 50%, 10 to 25% or more preferably 15 to 20% of the unoccupied free volume of the cavity. The unoccupied free volume of the cavity may be defined as the volume of the cavity (between the external surface of the shaft and the internal surface of the roller body) that is occupied by the lubricant surrounding, or submerging, the bearings.

According to a second aspect of the present invention there is provided a boring head comprising a plurality of cutters as claimed herein.

According to a further aspect of the present invention there is provided boring apparatus comprising a boring head and a plurality of cutters as described herein.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
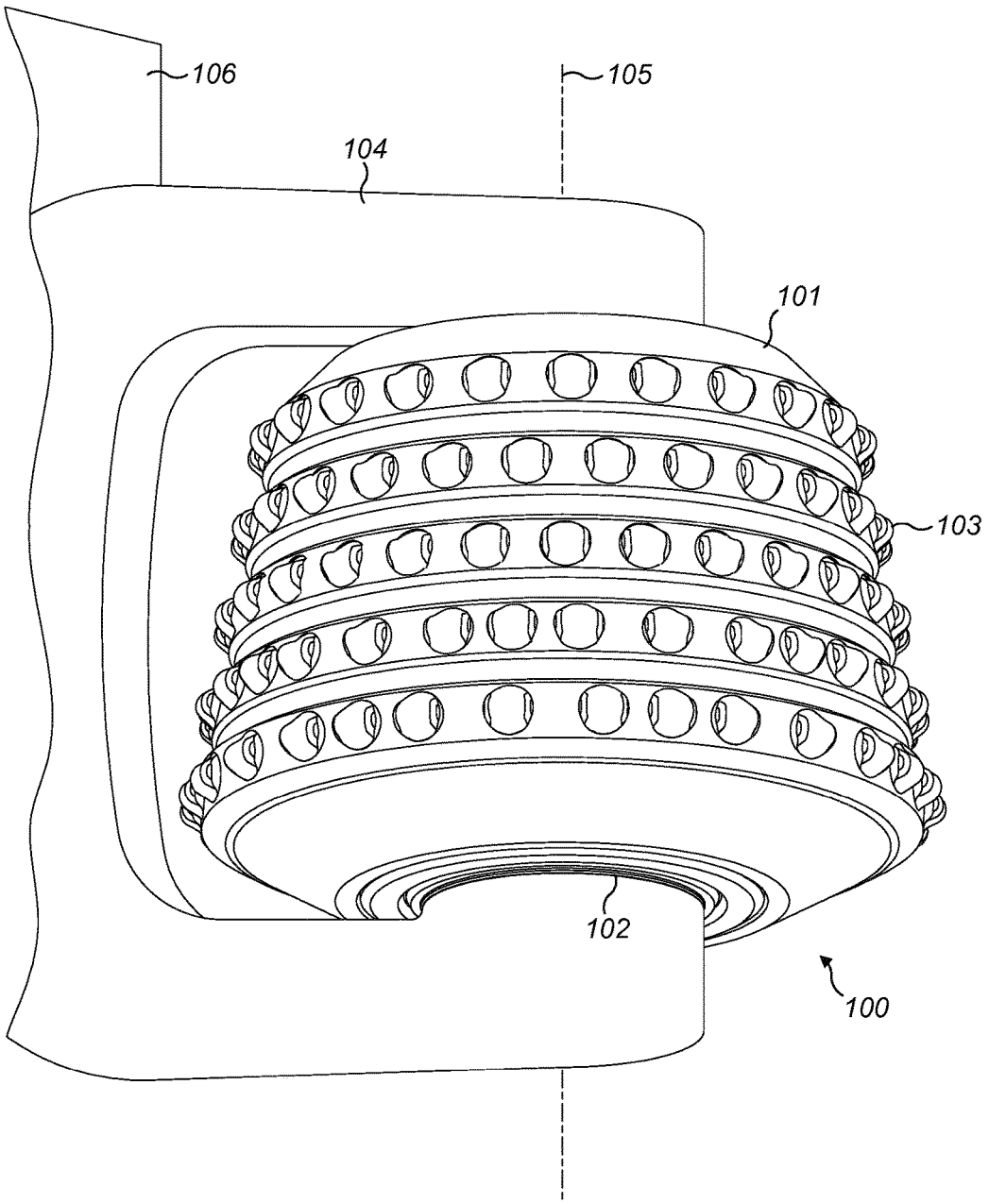
FIG. 1 is an external perspective view of a cutter mounted at a boring head according to a specific implementation of the present invention.

Referring to FIG. 1, a boring head 106 comprises a plurality of cutters 100 (alternatively termed reaming heads). Each cutter 100 comprises a rotatable frusto-conical roller body 101 mounted on a central shaft (or journal) 102. A plurality of annular rows of cutting inserts 103 project from an external face of the roller body 101 configured to work the rock as a roller body 101 rotates about the shaft 102. Shaft 102 is in turn mounted at a saddle 104 rigidly mounted at the boring head 106. Accordingly, each reaming head 100 is configured to rotate about axis 105 extending through the mounting shaft 102 with the axis 105 aligned transverse to the face of the boring head 106 from which the saddle 104 projects.

Figure 2:
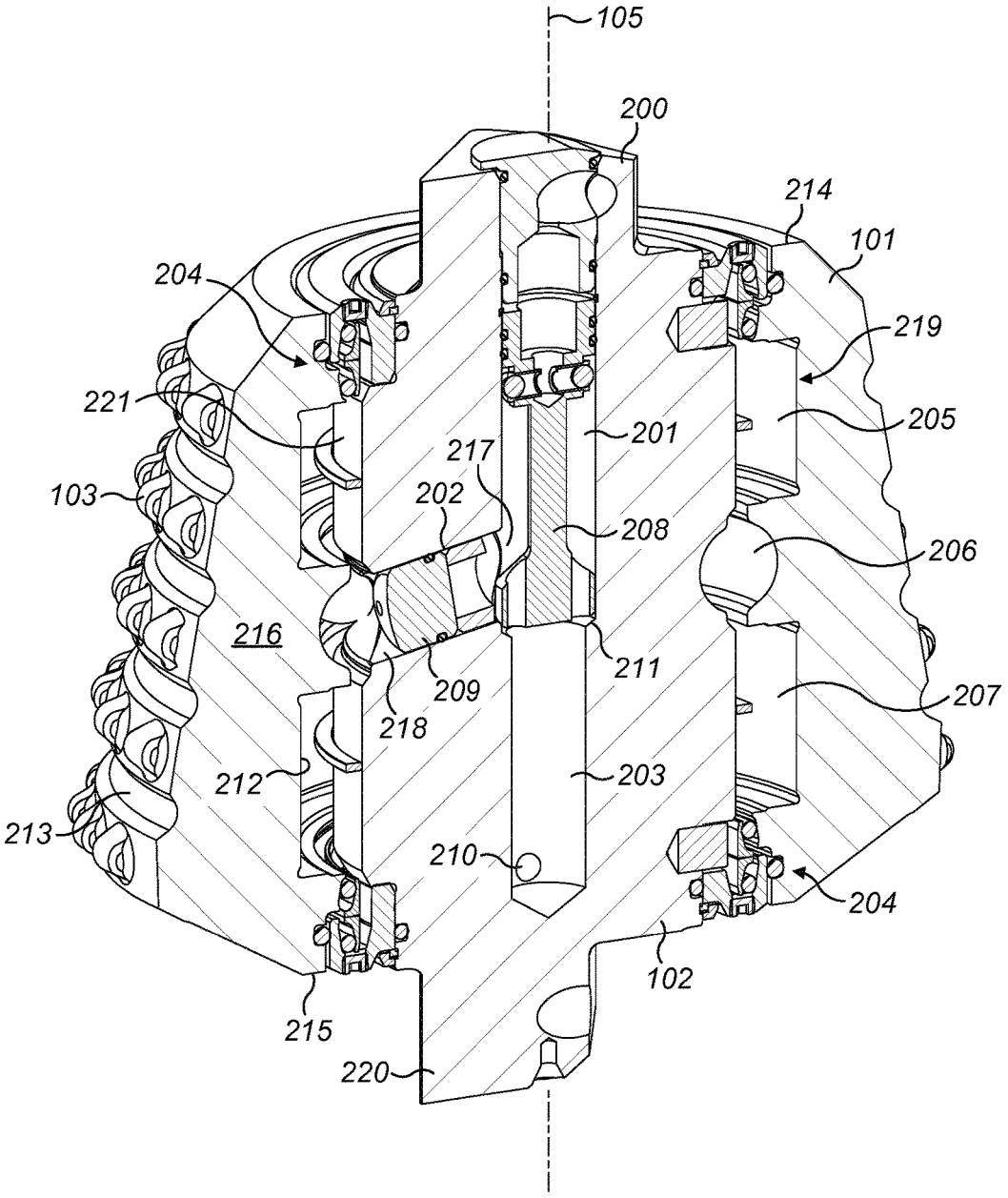
FIG. 2 is a cross sectional perspective view of the cutter of FIG. 1 in a first plane.

Referring to FIG. 2, roller body 101 comprises a first annular end 214 and a second annular end 215 with an internal facing surface 212 extending between ends 214, 215. Roller body 101 is accordingly formed as a hollow body having an annular wall indicated generally by reference 216 defined between internal facing surface 212 and an external facing surface 213 from which project the annular rows of cutting inserts 103. Roller body 101 is mounted about an external surface 221 of shaft 102 so as to surround external surface 221 between a first 200 and second 220 end of shaft 102. Roller body wall 216 comprises a series of annular recesses 205, 206, 207 that collectively define a bearing cavity 219 positioned radially between shaft 102 and roller body 101. Recesses 205, 207 are configured to mount two respective sets of roller bearings whilst annular recess 206 is configured to mount a plurality of ball bearings that, together with the roller bearings, define a collective bearing assembly to rotatably mount roller body 101 at shaft 102.

A first and second sealing assembly indicated generally by reference 204 is provided at the first and second ends 214, 215 of roller body 101 adjacent the shaft first and second ends 200, 220. The annular seal assemblies 204 comprise a series of O-rings and metal sealing rings/gaskets to provide a fluid tight seal to enclose and seal the bearing cavity 219. Seal assemblies 204 are configured to withstand an internal pressure within bearing cavity 219 of in the region of 0.3 to 0.4 MPa. That is, seal assemblies 204 are effective to prevent the loss of a lubrication fluid (typically grease) that occupies bearing cavity 219 to lubricate the rotational frictional contact of the bearings between the shaft 102 and roller body 101.

Shaft 102 comprises a first passageway 201 centred on axis 105 and formed as a cylindrical bore extending from shaft first end 200 to an approximate mid-length region of shaft 102. That is, an axial length of first passageway 201 is equal to approximately half the full axial length of shaft 102 between ends 200, 220. A second passageway 202 extends transverse to the first passageway 201 (and axis 105). Second passageway 202 provides a communication link between first passageway 201 and bearing cavity 219 such that a first end 217 of the second passageway 202 is provided in communication with first passageway 201 whilst a second end 218 of the second passageway 202 is provided in communication with bearing cavity 219 at the axial mid-region of the shaft 102 and roller body 101 corresponding to central annular recess 206. An elongate overflow chamber 203 is formed as a cylindrical bore and an axial extension of first passageway 201. That is, first passageway 201 and chamber 203 are coaxially aligned to be centred along shaft longitudinal axis 105. An axial length of chamber 203 is less than a corresponding axial length of first passageway 201 such that chamber 203 does not extend to emerge at the shaft second end 220 and is formed as a blind bore terminating within shaft 102 at an axial position corresponding to sealing assembly 204 (at shaft second end 220). Forming chamber 203 as a blind bore (having a termination end within the shaft) is advantageous to maximise the strength of the shaft 102 when mounted within saddle 104 to withstand the significant loading forces in use. A diameter of chamber 203 is less than a corresponding diameter of first passageway 201 so as to create an annular step 211 that projects radially inward towards axis 105 at the junction between the first passageway 201 and chamber 203. In particular, the annular step 211 is positioned at a first end 300 of chamber 203 and a second end 303 of first passageway 201, referring to FIG. 3. A first end 302 of first passageway 201 is open at shaft first end 200. Chamber 203 comprises second end 301 formed as a conical-shaped recess resultant from the two-stage manufacturing of the axially aligned first passageway 201 and chamber 203.

Figure 5:
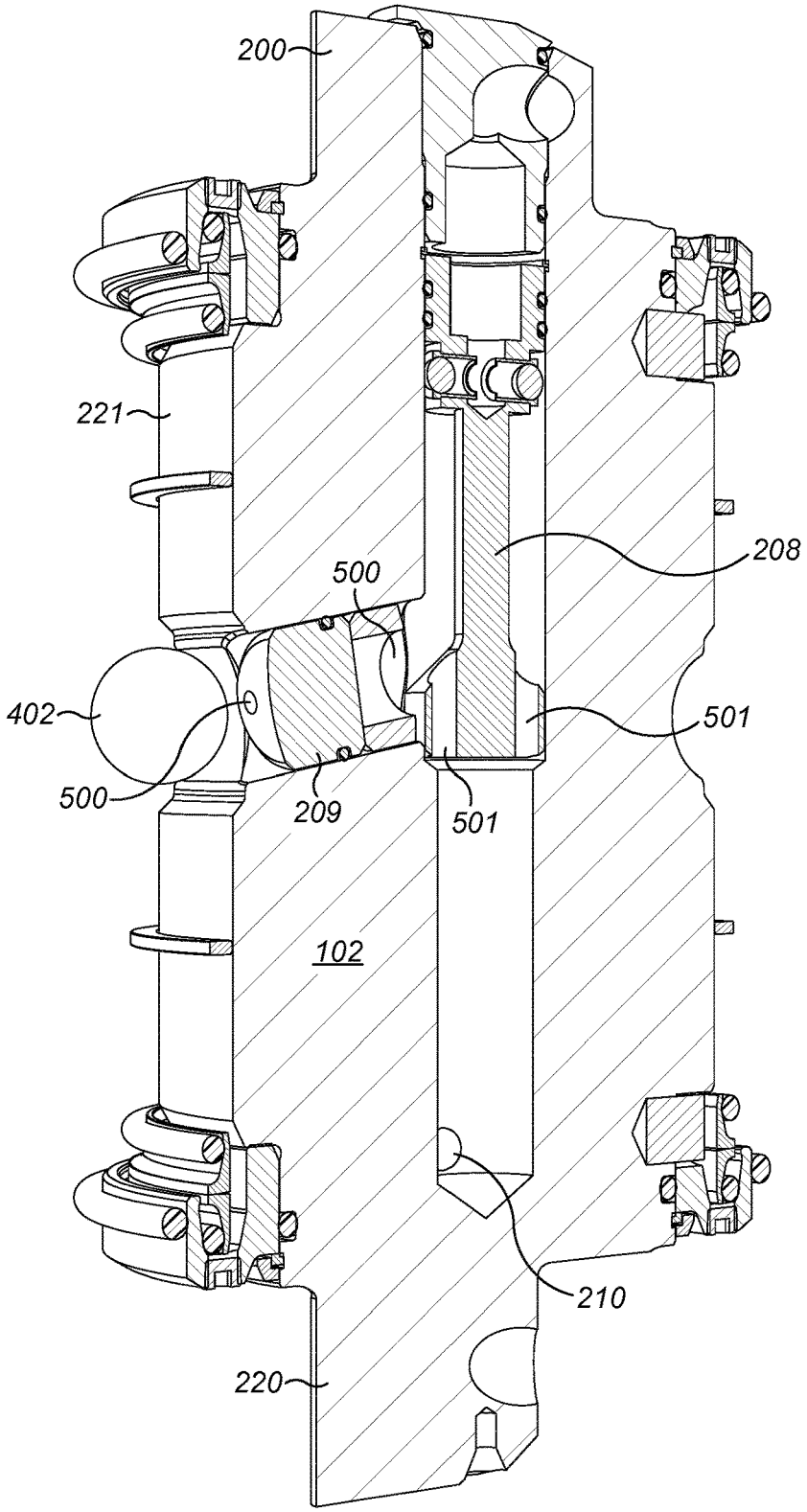
FIG. 5 is a cross sectional perspective view of the shaft (journal) part of the cutter of FIGS. 1 to 4 according to a specific implementation of the present invention.

A first ball plug 208 is accommodated within first passageway 201 an end of which is seated onto the annular step 211. A corresponding second ball plug 209 is accommodated within second passageway 202. Referring to FIG. 5, each plug 208, 209 comprises a plurality of communication bores 500, 501 that provide fluid communication pathways between bearing cavity 219 and the first and second passageways 201, 202 and overflow chamber 203.

Figure 3:
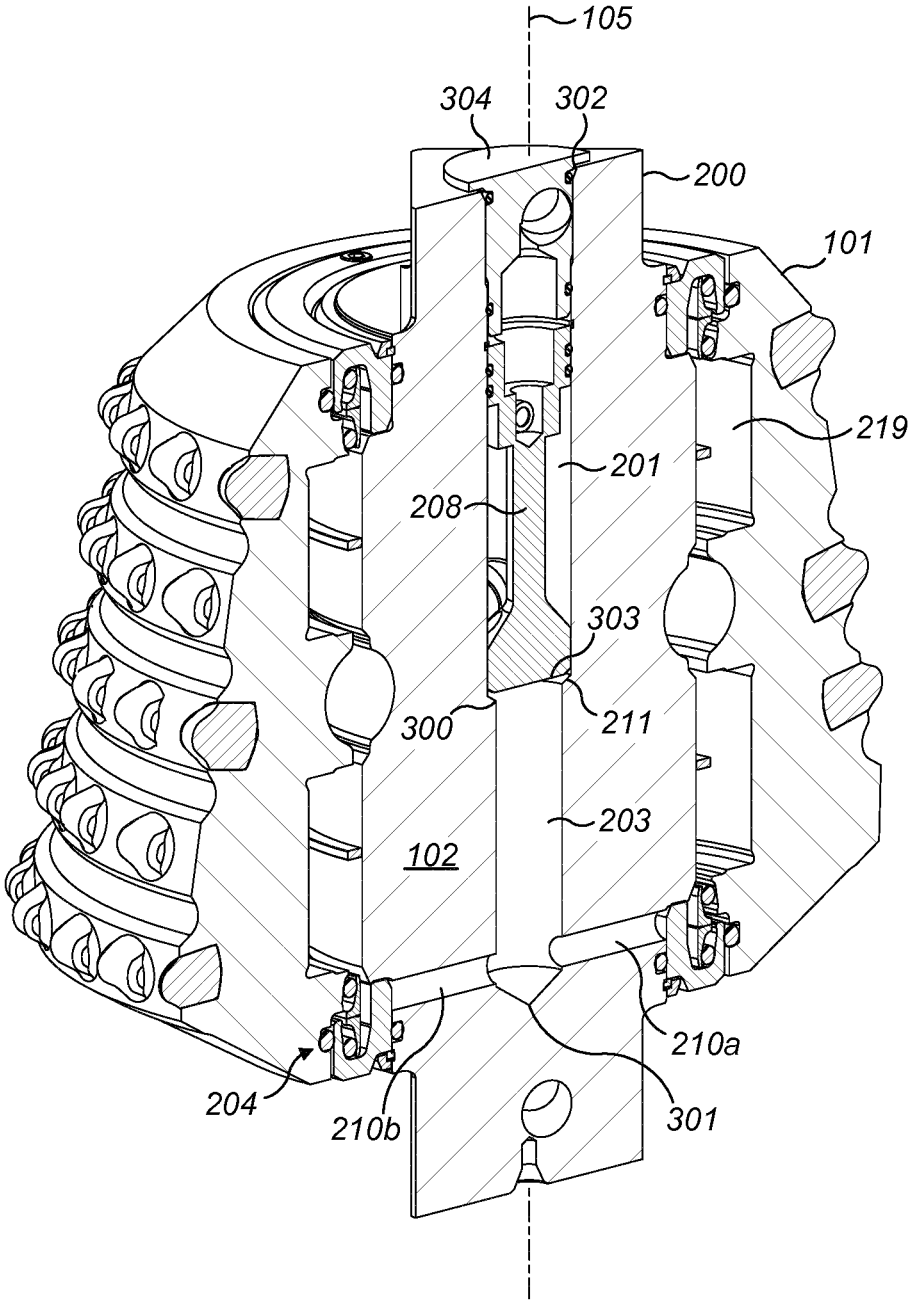
FIG. 3 is a cross sectional perspective view of the cutter of FIG. 1 in a second plane.

Referring to FIG. 3, a pair of further communication bores 210*a*, 210*b* extend perpendicular to axis 105 between the second end 301 of chamber 203 and one end of the bearing cavity 219 adjacent seal assembly 204 provided at the roller body second end 215. Communication bores 210*a*, 210*b* are configured to provide a further fluid communication pathway between the annular bearing cavity 219 and the internal passageways 201, 202 and chamber 203 within shaft 102. According to the specific implementation, a diameter of communication bores 500, 501, 210*a*, 210*b* is less than the diameters of the cylindrical first and second passageways 201, 202 and chamber 203. First passageway end 302 is sealed via a sealing plug 304 that forms an axial extension of first plug 208. Accordingly, lubrication grease introduced into bearing cavity 219 is sealed internally within cutter 100 via plug 304 and seal assemblies 204.

Figure 4:
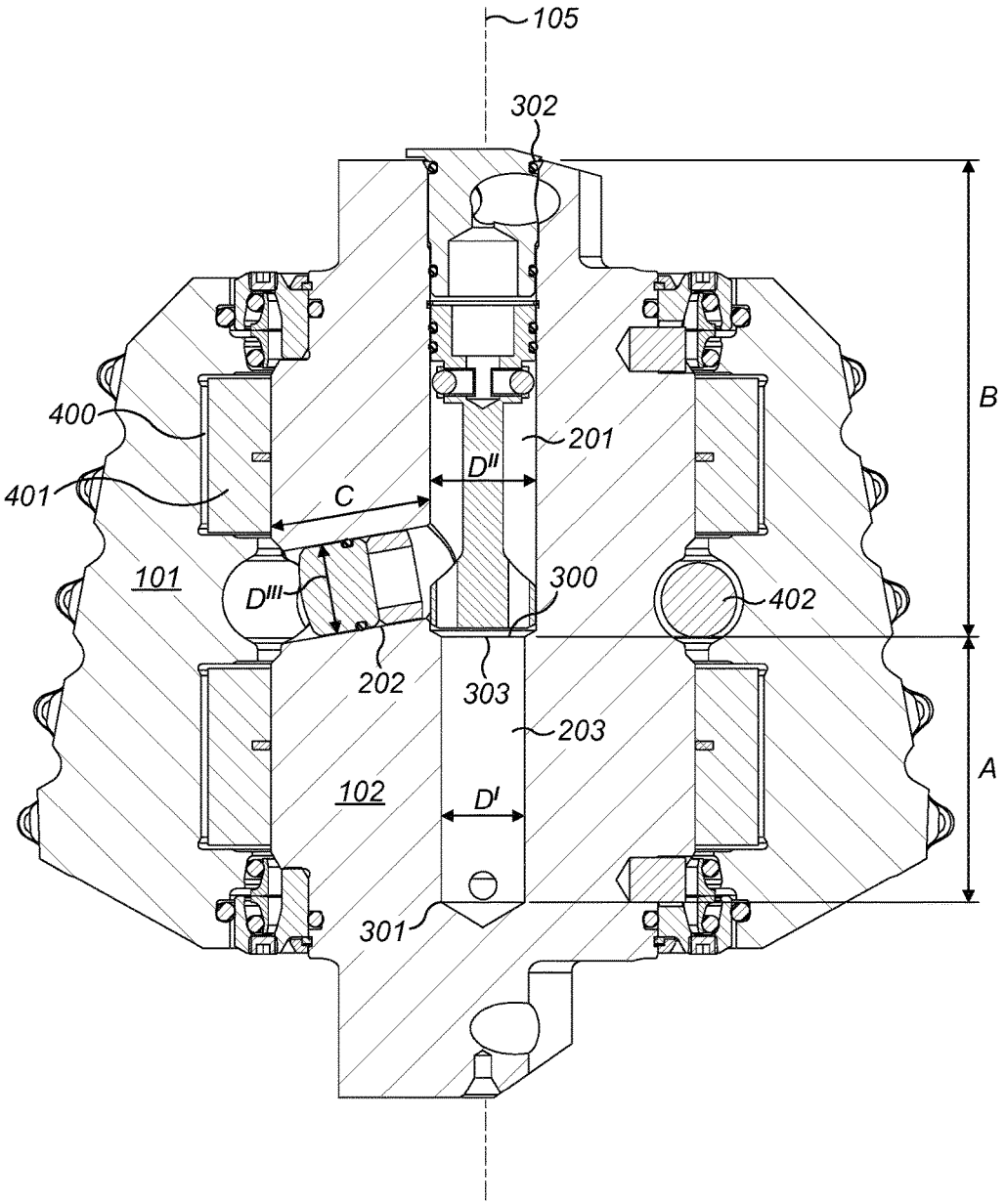
FIG. 4 is a cross sectional perspective view of the cutter in the same plane as FIG. 2.

Referring to FIG. 4, chamber 203 comprises an axial length A that is greater than its diameter D' so as to be elongate. According to the specific implementation length A is approximately three times diameter D'. First passageway is also elongate having an axial length B being greater than its diameter D". According to the specific implementation, chamber axial length A is less than first passageway axial length B as defined between chamber ends 300, 301 and the passageway ends 302, 303. Additionally, chamber axial length A is greater than a length C of second passageway 202 that extends in a radial direction between first passageway 201 and chamber cavity 219.

Moreover, chamber diameter D' is less than first passageway diameter D". Additionally, chamber diameter D' is less than a corresponding diameter D"' of second passageway 202. Accordingly, an internal volume of chamber 203 between ends 300, 301 is less than an internal volume of first passageway 201 but is greater than an internal volume of second passageway 202 without plugs 208, 209 accommodated within the respective passageways 201, 202.

In use and referring to FIGS. 2 to 5, overflow chamber 203 is unobstructed so as to be internally empty to define a free reservoir volume to receive thermally expanded lubrication fluid from the bearing cavity 219. With the roller bearings and the ball bearings (illustrated schematically by respective references 401, 402) accommodated within cavity 219 at the corresponding regions of recesses 205, 207, 206, a free volume 400 is defined as the unoccupied volume within the bearing cavity 219 as defined by roller body internal surface 212 and the shaft external surface 221. The free volume 400 surrounding the bearings 401, 402 is occupied by the lubrication grease. The grease is initially introduced into cavity 219 using an elongate delivery tool (not shown) inserted into the unoccupied first passageway 201 and chamber 203. The rod-shaped tool is inserted into chamber 203 so as to prevent the lubrication fluid from flowing into this internal region of shaft 102 and to direct it exclusively into the bearing cavity 219 where it is desired. That is, the fluid is supplied to bearing cavity 219 via an internal duct within the delivery tool extending through first and second passageways 201, 202 and bypassing chamber 203. The plugs 208, 209, 304 are then inserted in position as illustrated in FIGS. 2 to 5. Chambers 203 is provided in fluid communication with the free volume 400 (and the lubrication fluid) via communication bores 500, 501 and 210*a*, 210*b*. During use and rotation of roller body 101 about axis 105 and shaft 102, the lubrication grease is heated from ambient to approximately 160° C. causing the fluid to expand within free volume 400 and elevate the internal pressure against the seal assemblies 204.

The grease expands within free volume 400 and is capable of flowing internally within the shaft 102 via communication bores 500, 501 and 210*a*, 210*b*. The unoccupied free space within chamber 203 is approximately 10 to 25% of the free volume 400 and is based, in part, on the thermal expansion coefficient of the lubrication fluid and in particular the volume of the fluid at the operating temperature of the cutter (approximately 160° C.). The free-flow of fluid between the chamber 203 and cavity 219 maintains the pressure within cavity 219 below the maximum pressure of the seal assemblies 204 which may be typically 0.3 to 0.4 MPa. The thermally expanded and heated fluid is accordingly configured to collect in the reservoir chamber 203 to relieve the pressure within cavity 219 and avoid seal failure and loss of lubricant from cutter 100. The present configuration is also advantageous avoid the return flow of contaminated lubricant that may otherwise occur with conventional arrangements that employ elastomeric reservoirs or wells. The overflow chamber 203 comprising multiple fluid flow inlets and outlets (501, 210*a*, 210*b*) is advantageous to provide the reliable and unhindered free-flow of lubricant between chamber 203 and cavity 219 resultant from lubricant expansion and contraction.

The invention claimed is:

1. A cutter for a boring head, the cutter comprising:

a shaft having a longitudinal axis mountable at a saddle of a boring head;

a frusto-conical roller body rotatably mounted about the shaft and having cutting elements provided at an external face;

bearings mounted within an annular cavity located radially between the shaft and the roller body;

a first passageway centred on the axis of the shaft and extending axially through the shaft from a first end, which first end is located at the distal end of the roller body having the smallest diameter;

a second passageway extending transverse or perpendicular to the first passageway to provide a fluid link between the first passageway and the cavity; and an elongate overflow chamber centred on the axis of the shaft and formed as an elongate axial extension of the first passageway to extend axially through the shaft beyond the second passageway as a blind bore, the chamber having an unoccupied internal volume along its axial length configured to receive a lubrication fluid from the annular cavity.

2. The cutter as claimed in claim 1, wherein the axial length of the chamber is in the range 1.5 to 5.0 times a diameter or width of the chamber in a radial direction.

3. The cutter as claimed in claim 2, wherein the range is 2.5 to 3.5.

4. The cutter as claimed in claims claim 1, wherein the first passageway and the chamber are substantially cylindrical.

5. The cutter as claimed in claim 4, wherein a diameter of the first passageway is greater than a diameter of the chamber.

6. The cutter as claimed in claim 1, wherein an axial length of the first passageway is greater than the axial length of the chamber.

7. The cutter as claimed in any claim 1, wherein an axial junction of the first passageway and the chamber includes an abutment or a step that projects radially inward towards the axis.

8. The cutter as claimed in any claim 1, further comprising a first plug removably mounted in the first passageway to close an open end of the first passageway and a second plug removably mounted in the second passageway.

9. The cutter as claimed in claim 8, wherein the first and second plugs each have at least one communication bore arranged to provide a fluid flow path between the cavity and the respective first and second passageways.

10. The cutter as claimed in any claim 1, further comprising at least one communication bore extending through the shaft to allow the transfer of the lubrication fluid between the chamber and the cavity.

11. The cutter as claimed in claim 10, comprising a plurality of communication bores extending transverse or perpendicular to the chamber from one end of the chamber axially furthest from the second passageway.

12. The cutter as claimed in any claim 1, wherein a volume of the chamber is less than an unoccupied free volume of the cavity.

13. The cutter as claimed in claim 12, wherein the volume of the chamber (203) is in the range 5 to 50% of the unoccupied free volume (400) of the cavity (219).

14. The cutter as claimed in claim 13, wherein the range is 10 to 25%.

15. A boring head comprising a plurality of cutters, each of the cutters including a shaft having a longitudinal axis mountable at a saddle of a boring head, a frusto-conical roller body rotatably mounted about the shaft and having cutting elements provided at an external face, bearings mounted within an annular cavity located radially between the shaft and the roller body, a first passageway centred on the axis of the shaft and extending axially through the shaft from a first end, which first end is located at the distal end of the roller body having the smallest diameter, a second passageway extending transverse or perpendicular to the first passageway to provide a fluid link between the first passageway and the cavity, and an elongate overflow chamber centred on the axis of the shaft and formed as an elongate axial extension of the first passageway to extend axially through the shaft beyond the second passageway as a blind bore, the chamber having an unoccupied internal volume along its axial length configured to receive a lubrication fluid from the annular cavity.

* * * * *